United States Patent [19]

Maskens

[11] 4,212,049

[45] Jul. 8, 1980

[54] GUIDEO CARRIAGE ASSEMBLY FOR PHOTODRAFTING EQUIPMENT

[75] Inventor: Geoffrey D. Maskens, Sturminster Marshall, England

[73] Assignee: Quest Automation Limited, Dorset, England

[21] Appl. No.: 836,826

[22] Filed: Sep. 26, 1977

[30] Foreign Application Priority Data

Sep. 28, 1976 [GB] United Kingdom ..... 40195/76

[51] Int. Cl.[2] ..... A61G 13/00

[52] U.S. Cl. ..... 362/33; 362/97; 354/77

[58] Field of Search ..... 362/33; 354/97, 77

[56] References Cited

U.S. PATENT DOCUMENTS 2,877,556 3/1959 Hulen ..... 362/97

*Primary Examiner*—Stephen J. Lechert, Jr.

*Attorney, Agent, or Firm*—Pollock, VandeSande and Priddy

[57] ABSTRACT

A guided carriage assembly for photodrafting equipment comprises a carriage and guide means for the carriage wherein the guide means comprises three parallel rails presenting accurately ground horizontally extending straight edges, one of the outermost straight edges lying in a horizontal plane and the other outermost edge and the intermediate edge being inclined to the horizontal in opposite directions, and the carriage assembly comprises two pairs of aligned rollers bearing on the inclined edges and a single roller bearing on the horizontal edge. The arrangement is such that the precision of movement of the carriage is governed substantially entirely by the straightness of the edges. A preferred embodiment comprises two such assemblies one mounted atop the other with the rails of the one extending orthogonally to those of the other whereby to provide an X-Y table.

8 Claims, 3 Drawing Figures

GUIDEO CARRIAGE ASSEMBLY FOR PHOTODRAFTING EQUIPMENT

BACKGROUND OF THE INVENTION

This invention relates to guided carriage assemblies suitable for use in photodrafting equipment and the like.

SUMMARY OF THE INVENTION

It is an object of the invention to provide a photodrafting equipment comprising a guided carriage assembly of straight-forward construction in which a carriage is constrained by guide means to move in a straight line with high precision, which requires a minimum of precision components, and wherein those precision components which are required are of easy manufacture or available as standard machine-tool items.

It is a more specific object of the present invention to provide a guided carriage assembly of straight-forward construction in which a carriage is constrained by guide means to move in a straight line wherein the precision of movement of the carriage is determined substantially wholly by the straightness of three straight edges which are the edges of separate elongate plates clamped to a base structure.

The invention provides a guided carriage assembly comprising a carriage and guide means for supporting the carriage for linear movement of the carriage relative thereto the guide means comprising first, second and third individual support members fixed to a base structure and presenting respective straight edges extending in one direction, and the carriage comprising bearing means for bearing on the said straight edges to support the carriage and to track therealong on movement of the carriage in the said direction, the carriage being arranged for the bearing means to bear on the first straight edge at first and second spaced points with the lines of the reaction forces exerted thereat lying in a first plane parallel with the said direction, to bear on the second straight edge at third and fourth spaced points with the lines of the reaction forces exerted thereat lying in a second plane parallel with the said direction, the second plane being inclined to the first plane, and to bear on the third straight edge at a fifth point with the line of the reaction force exerted thereat lying in a plane parallel with the said direction, the third plane being spaced from the line of intersection of the first and second planes.

DESCRIPTION OF THE ILLUSTRATED EMBODIMENTS

In order that the invention may be clearly understood and readily carried into effect, an embodiment thereof will now be described by way of example with reference to the accompanying drawings wherein:

FIG. 3 is an end view of the carriage and guide means illustrated in FIG. 2.

Figure 1:
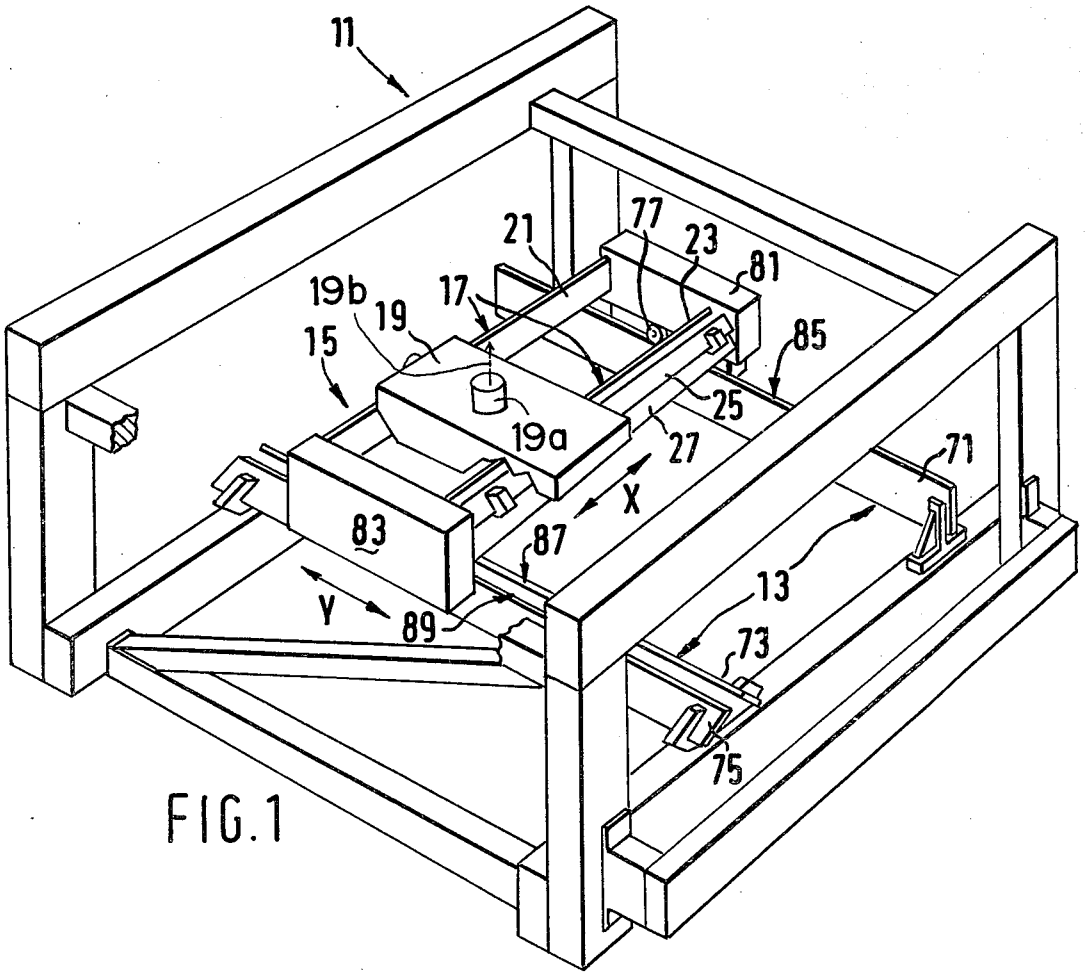
FIG. 1 is a perspective view of a guided carriage assembly in accordance with the invention.

The photodrafting assembly of FIG. 1 comprises a rigid frame 11 provided with first guide means 13 supporting a first carriage 15 which is linearly movable along the guide means 13 in the Y-direction indicated. The carriage 15 itself comprises second guide means 17 and a second carriage 19 linearly movable along the guide means 17 in the X-direction indicated, that is to say, in the direction at right-angles to the direction of movement of the carriage 15 as a whole. The carriage 19 is thus movable in both X- and Y-coordinate directions relative to the frame 11.

The guide means 17 comprises three rails 21, 23 and 25 extending in the direction of the X-axis, the rail 21 being rigidly clamped to a first longitudinal chassis member 26 (FIG. 3) of the carriage 15, and the rails 23 and 25 being rigidly clamped to a second longitudinal chassis member 27 of the carriage 15. The carriage 19 is provided with bearing means which bear against the upper edges of the rails 21, 23 and 25 to support the weight of the carriage 19.

Figure 2:
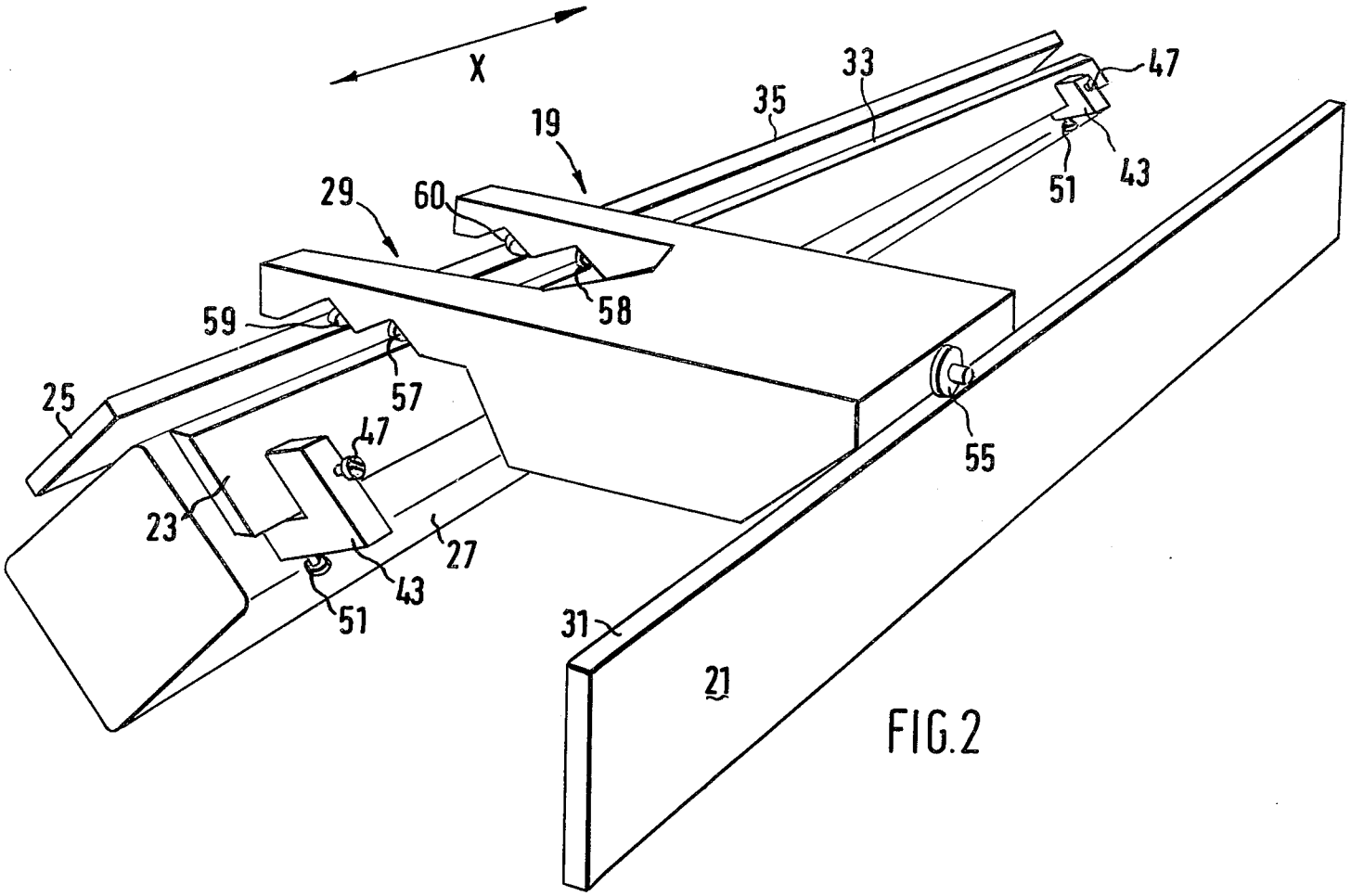
FIG. 2 is a perspective view in greater detail of a carriage and guide means therefor of the assembly of FIG. 1.

The assembly of the guide means and carriage 19 is illustrated in greater detail in FIGS. 2 and 3, the carriage 19 being shown partly cut-away at 29 to reveal the constructional features more clearly. The rails 21, 23 and 25 comprise respective flat, elongate steel plates the respective upper side edges 31, 33 and 35 thereof each having been machined or ground accurately straight in the direction of the length of the edge.

Rail 21 is clamped to chassis member 26, by means of G-clamps 37 (only one shown) fast with the member 26 provided with clamping screws 39, with the directions of the length and width of its straight edge 31 lying in a substantially horizontal plane. Jacking screws 41 are provided in the G-clamps 37 for engagement with the lowermost edge of the rail to provide means for fine adjustment of the level of the straight edge.

Rails 23 and 25 are clamped to chassis member 27, by means of G-clamps 43 and 45 fast with the member 27 provided with clamping screws 47 and 49, with the directions of the lengths of their edges 33 and 35 being substantially parallel and extending substantially horizontally and the directions of the widths of the edges being oppositely inclined to the horizontal at an angle of substantially 45 degrees. Jacking screws 51 and 53 are provided in the G-clamps 43 and 45 for engagement with the lower edges of the rails 23 and 25 to provide means for fine adjustment of the directions of the lengths of the straight edges.

The bearing means bearing on the upper edge 31 of the rail 21 comprises a single roller 55 journalled to the chassis of the carriage 19 about a horizontal axis extending in the dirction of the width of the edge 31, and peripherally engaging that edge. The bearing means bearing on the upper edge 33 of the rail 23 comprises two aligned rollers 57 and 58 journalled to the chassis of the carriage 19 about parallel axes extending in the direction of the width of the edge 33, that is to say, at an inclination of substantially 45 degrees to the horizontal. Similarly, the bearing means bearing on the upper edge 35 of the rail 25 comprises two aligned rollers 59 and 60 journalled to the chassis of the carriage 19 about parallel axes extending in the direction of the width of the edge 35, that is to say, at an inclination of substantially 45 degrees to the horizontal in a direction opposite to that of the inclination of the axes of rollers 57 and 58. Thus, the weight of the chassis 19 is supported by the rollers 55 and 57 to 60 bearing on the straight edges, and the rollers can track along those edges to permit free movement of the carriage 19 in the X-direction.

The described geometry of the guide means 17 and associated bearing means on the carriage 19 is such as to provide positive lateral and angular location of the carriage 19 in the plane transverse to the X-direction.

The reaction forces exerted on the rollers 57 to 60 by straight edges 33 and 35 under the weight of the carriage 19 lie in first and second planes extending in the X-direction which are inclined to one another, thereby positively determining the lateral position of the carriage in the transverse plane, and the reaction force exerted on the roller 55 by straight edge 31 lies in a third plane extending in the X-direction which is spaced from the line of intersection of the first and second planes thereby positively determining the angular orientation of the carriage in the transverse plane. The lines of the reaction forces exerted by the edges 31, 33 and 35, which lines extend orthogonally to the respective edge faces, are indicated in FIG. 3 at 61, 63 and 65 respectively. The line of intersection of the first and second planes is a line passing through the point 67 in the direction orthogonal to the plane of the drawing of FIG. 3.

Moreover, the quadrupedal disposition of the rollers 57 to 60 on the two mutually inclined faces of the straight edges 33 and 35 provides positive angular location of the carriage 19 in the horizontal plane also, that is to say, positively determines the angular orientation of the carriage about the vertical.

It will be appreciated from the above that the carriage 19 is constrained by the guide means 17 to move in a straight line with a precision limited only by the precision with which the edges 31, 33 and 35 can be made accurately straight (assuming there is no difficulty in ensuring that the rollers 55 and 57 to 60 can be made to run truly concentrically with their respective journals). It will further be appreciated that the edges of flat steel plates such as those forming the rails 21, 23 and 25 can be ground or otherwise worked to provide a straight surface with an extremely high accuracy. Moreover, since the rails 21, 23 and 25 are separate components, they can be prepared, inspected and tested for straightness using special techniques before assembly with the equipment. In practice this can be a considerable advantage particularly to smaller engineering workshops which might not have access to specialist facilities. Indeed, steel plates with precision ground straight edges can be obtained on the market as standard items.

Misalignment of the straight edges does not affect the straightness of movement of the carriage, but it can cause rotation of the carriage about an axis parallel with the direction of movement and will also affect the direction of movement itself. In most applications, however, the prime requirement is for the carriage to move accurately and predictably in a straight line, the angular orientation of the carriage about that line and the absolute direction of the line being somewhat less critical. Moreover, the angular orientation of the carriage and the absolute direction of movement can be adjusted by means of the jacking screws 41, 51 and 53. In particular, adjustment of jacking screws 51 and 53 to alter the relative orientation of the directions of the lengths of the straight edges 33 and 35 can be effected to cause variation in the horizontal plane of the direction of movement of the carriage. This provides convenient means for fine adjustment of the angle between the directions of movement of the carriage 19 relative to the chassis of carriage 15 and movement of carriage 15 relative to the frame 11 (FIG. 1), thereby enabling the X- and Y- directions of movement of the carriage 19 to be set accurately to a right-angle.

Referring again to FIG. 1, the guide means 13 comprises three rails 71, 73 and 75 extending in the direction of the Y-axis and each rigidly clamped to the frame 11. The carriage 15 is provided with bearing means comprising rollers 77 (only one shown) journalled to the transverse chassis members 81 and 83 of the carriage which bear against the upper edges 85, 87 and 89 of the respective rails and carry the weight of the carriage. The rollers are arranged to track along the edges 85, 87 and 89 to permit free movement of the carriage 15 in the Y-direction.

The construction and arrangement of the guide means 13 and associated bearing means on the carriage 15 are essentially identical to those of the guide means 17 and bearing means of carriage 19 described above. In particular the rails 71, 73 and 75 are formed by respective individual steel plates with the edges 85, 87 and 89 ground accurately straight, and the geometry is arranged in the manner described above to provide precision movement of the carriage in a straight line.

It is to be noted from the above that each carriage 15 and 19 has a range of travel which is not substantially less than the length of the associated guide means. Moreover, the construction is straight forward requiring few precision parts, and straightness of movement does not depend on the accuracy of alignment of any of the components. Furthermore precision of movement is ensured without recourse to spring biassing or other locating means liable to cause frictional restraint upon movement and increased wear: positive location of the carriages in directions other than their respective required directions of movement is effected by the action of gravity alone.

The guided carriage assembly of FIG. 1 is particularly suitable for use in photodrafting equipment, that is to say, equipment of the type which projects a spot of light onto a photosensitive surface, the spot of light being moved relative to the surface to expose a line thereon. In such equipment, precision placement of the spot of light on the photosensitive surface is required, usually with reference to rectangular X- and Y- coordinates.

Photodrafting equipment comprising the assembly of FIG. 1 includes Y-drive means (not shown) mounted on the frame 11 for driving the carriage 15 along the guide means 13 by means, for example of a lead screw, and X-drive means (not shown) mounted in the chassis of carriage 15 for driving the carriage 19 along the guide means 17 by means for example, of a second lead screw. Photo-projection means, diagrammatically shown at 192, is mounted on the carriage 19 and arranged to project a beam of light 196 vertically, upwardly and means (not shown) are provided for supporting a sheet of photosensitive material on the frame 11, the sheet being disposed in a horizontal plane above the photo-projection means for exposure by the upwardly directed light beam. The photoprojection means **19*a*** may take the form shown, for example, in Eadie et al U.S. Pat. No. 4,123,763; Frehling U.S. Pat. No. 3,903,527; Mader U.S. Pat. No. 3,673,937; or Gerber et al U.S. Pat. No. 3,610,119.

In use, the light spot can be moved to any required position on the photosensitive surface, or moved along any required line on that surface, by appropriate operation of the X- and Y-drive means. Preferably, means are provided for monitoring movement of the carriage 15 along the guide means 13 and movement of the carriage 19 along the guide means 17. In this way, placement of the light spot on the photosensitive surface can be controlled with considerable precision having regard to the precision of the straightness of movement of the carriages 15 and 19 on their respective guide means, and the stability and positive location of the carriages in directions transverse to their respective directions of movement.

I claim:

1. Photodrafting equipment comprising a guided carriage assembly having a carriage, photo-projection means on said carriage, and guide means for supporting the carriage for linear movement of the carriage and photo-projection means relative to said guide means, the guide means comprising first, second and third individual support members fixed to a base structure and presenting respective straight edges extending in one direction, and the carriage comprising bearing means for bearing on the said straight edges to support the carriage and to track therealong on movement the carriage in the said direction, the carriage being arranged for the bearing means to bear on the first straight edge at first and second spaced points with the lines of the reaction forces exerted thereat lying in a first plane parallel with the said direction, to bear on the second straight edge at third and fourth spaced points with the lines of the reaction forces exerted thereat lying in a second plane parallel with the said direction, the second plane being inclined to the first plane, and to bear on the third straight edge at a fifth point with the line of the reaction force exerted thereat lying in a plane parallel with the said direction, the third plane being spaced from the line of intersection of the first and second planes.

2. Photodrafting equipment as claimed in claim 1 wherein said carriage comprises a chassis and said bearing means comprises first and second aligned rollers journalled to said chassis about substantially parallel axes extending at right-angles to said one direction, said first and second rollers peripherally engaging said first straight edge at said first and second spaced points respectively, third and fourth aligned rollers journalled to said chassis about substantially parallel axes extending at right-angles to said one direction, said third and fourth rollers peripherally engaging said second straight edge at said third and fourth spaced points respectively, and a fifth roller journalled to said chassis about an axis extending at right-angles to said one direction, said fifth roller peripherally engaging said third straight edge at said fifth point.

3. Photodrafting equipment as claimed in claim 1 wherein said first, second and third individual support members comprise respective first, second and third elongate steel plates clamped to said base structure, said straight edges being formed by respective straight, flat edges of respective ones of said first, second and third plates.

4. Photodrafting equipment as claimed in claim 3 wherein said one direction is substantially horizontal, said first and second plates are clamped to said base structure so that said straight flat edges thereof are uppermost and the widths of said edges are inclined to the horizontal in opposite directions, and said third plate is clamped to said base structure so that the said straight flat edge thereof is uppermost and lies in a substantially horizontal plane.

5. Photodrafting equipment as claimed in claim 4 wherein the said widths of said straight flat edges of said first and second plates are inclined to the horizontal at substantially 45 degrees.

6. Photodrafting equipment as claimed in claim 4 wherein said base structure is provided with jacking screws engaging lower edges of said first, second and third plates to provide means for finely adjusting the levels of said straight flat edges.

7. Photodrafting equipment comprising first and second guided carriage assemblies each as claimed in claim 1 wherein the carriage of said first assembly forms the base structure of said second assembly and the said one direction of said first assembly is substantially at right-angles to the said one direction of said second assembly whereby the carriage of said second assembly forms a table movable in both coordinate directions of a plane.

8. Photodrafting equipment comprising apparatus as claimed in claim 7 wherein said photo-projection means is mounted on said table and arranged to project a beam of light orthogonally to the said plane in which said table is movable.

* * * * *